US005630331A

United States Patent [19]

Miyamoto

[11] Patent Number: 5,630,331

[45] Date of Patent: May 20, 1997

[54] KEY CYLINDER AUTOMATIC RETURNING DEVICE FOR CYLINDER LOCK DEVICE

[75] Inventor: Keiichi Miyamoto, Kanagawa, Japan

[73] Assignee: Alpha Corporation, Kanagawa, Japan

[21] Appl. No.: 430,610

[22] Filed: Apr. 28, 1995

[30] Foreign Application Priority Data

Apr. 28, 1994 [JP] Japan ..... 6-092737

[51] Int. Cl.[6] ..... E05B 9/10

[52] U.S. Cl. ..... 70/379 R; 70/380; 70/367; 70/DIG. 36

[58] Field of Search ..... 70/379 A, 379 R, 70/372, 380, 367, 490, 492, 493, DIG. 36, DIG. 54, DIG. 55; 292/336.3, DIG. 61

[56] References Cited

U.S. PATENT DOCUMENTS

| | | | |
|---|---|---|---|
| 1,876,803 | 9/1932 | Von Mehren | 70/380 |
| 3,310,642 | 3/1967 | Zeller | 70/372 |
| 4,633,689 | 1/1987 | Wolniak et al. | 70/DIG. 36 X |
| 4,634,822 | 1/1987 | Goeke | 70/379 A X |
| 4,655,062 | 4/1987 | Kaufman | 70/380 X |
| 4,903,512 | 2/1990 | Leroy et al. | 70/379 R |
| 4,936,895 | 6/1990 | LeClerc et al. . | |
| 5,186,030 | 2/1993 | Lin | 70/379 R X |
| 5,263,348 | 11/1993 | Wittwer | 70/379 R |
| 5,265,453 | 11/1993 | Konii et al. | 70/379 R |
| 5,285,667 | 2/1994 | Fukasawa et al. | 70/380 X |
| 5,428,978 | 7/1995 | Tsukano | 70/379 R X |

FOREIGN PATENT DOCUMENTS

| | | | |
|---|---|---|---|
| 498510 | 1/1920 | France | 70/DIG. 36 |
| 2620755 | 3/1989 | France . | |
| 17354 | 12/1887 | United Kingdom | 292/DIG. 61 |

*Primary Examiner*—Suzanne L. Dino

*Attorney, Agent, or Firm*—Nikaido, Marmelstein, Murray & Oram LLP

[57] ABSTRACT

A cylinder shaft projects from a key cylinder along the center line of a sleeve, and first and second case shafts project from a case. A spring is coiled on the first case shaft, and the cylinder shaft is placed between the first and second case shafts. The cylinder shaft and the second case shaft are placed between both legs of the spring. When the key cylinder is rotated with respect to the sleeve by the proper key being inserted in the key cylinder, the spring imparts returning force to the cylinder shaft that is making an arcuate movement in a circular-arc groove formed in the case.

3 Claims, 5 Drawing Sheets

KEY CYLINDER AUTOMATIC RETURNING DEVICE FOR CYLINDER LOCK DEVICE

BACKGROUND OF THE INVENTION

The present invention relates to a cylinder lock device and, more particularly, to a cylinder lock with high resistance to destruction, and in which a rotated key cylinder is automatically returned to the original position by a spring.

In conventional cylinder locks, the proper key can be rotated to the locked position or the unlocked position in a key cylinder provided with tumblers that engage with a groove formed in a case. However, in such a conventional cylinder lock which prevents rotation of the key cylinder by means of the tumblers that are engaged with the groove of the case, there is a possibility that the cylinder lock is locked by destroying the tumblers. To solve this problem, as disclosed in, for instance, Japanese Unexamined Patent Publication No. Hei. 1-315569, a free-turn cylinder lock has been proposed in which a key cylinder is freely rotated when it is given rotational force in an illegal unlocking attempt. This type of cylinder lock has a sleeve rotatably incorporated in a case and the key cylinder rotatably supported in a second housing of a sleeve.

When the proper key is inserted into the key cylinder, the tumblers in the key cylinder are disengaged from the groove formed in the sleeve, to allow the key cylinder to be rotated relative to the sleeve. As a result, a slide ring engages with a lock-piece operating member and it becomes possible to actuate a lock device.

When an improper key is inserted into the key cylinder, the tumblers hold the key cylinder in the state of being engaged with the sleeve, to cause the key cylinder to be rotated together with the sleeve. Since the lock-piece operating member is not rotated, the lock device cannot be actuated.

When an improper key is used in the above type of free-turn cylinder lock, the key cylinder is allowed to freely rotate; that is, it is impossible to apply rotational force strong enough to destroy the tumblers. Thus, the cylinder lock can have high resistance to destruction.

On the other hand, in the free-turn cylinder lock, because of the structure in which the sleeve rotates together with the key cylinder when the key cylinder is rotated by an improper key, a return spring cannot be provided between the key cylinder and the case. Therefore, when rotational force is removed from the proper key after it is inserted into the key cylinder and rotated, the key cylinder does not automatically return to the original position. This requires cumbersome operations of manually returning the key to the original position and then pulling out the key from the key cylinder.

SUMMARY OF THE INVENTION

An object of the present invention to provide a key cylinder automatic returning device for a free-turn lock device which automatically returns the proper key to the original position when the key cylinder is rotated by the proper key.

A cylinder lock device to which the invention is directed comprises a case having a first housing, a sleeve rotatably incorporated in the first housing of the case and having a second housing and an engaging portion, a key cylinder rotatably incorporated in the second housing of the sleeve, and tumblers slidably arranged in the key cylinder and capable of engaging with the engaging portion of the sleeve. The key cylinder is rotated with respect to the sleeve when a proper key is inserted into the key cylinder and turned, and the key cylinder and the sleeve are rotated together when an improper key is inserted into the key cylinder and turned. A key cylinder automatic returning device for the above cylinder lock device comprises first and second case shafts projecting from the case; a cylinder shaft projecting from the key cylinder along a center line of the sleeve, and located between the first and second case shafts; and a spring coiled on the first case shaft, and having two legs between which the cylinder shaft and the second case shaft are placed. When the key cylinder is rotated with respect to the sleeve by the proper key being inserted in the key cylinder, the spring imparts returning force to the cylinder shaft that is making an arcuate movement in a circular-arc groove formed in the case. When the key cylinder and the sleeve are rotated together by an improper key being inserted in the key cylinder, the cylinder shaft is rotated on the center line of the sleeve in the circular-arc groove of the case and between the two legs of the spring without deforming the spring.

According to another aspect of the invention, there are provided a sleeve central shaft projecting from the sleeve along a center line of the sleeve; a sleeve eccentric shaft deviated from the center line of the sleeve and projecting therefrom; a cylinder shaft deviated from the sleeve central shaft, projecting from the key cylinder, and located between the sleeve central shaft and the sleeve eccentric shaft; and a spring coiled on the sleeve central shaft, and having two legs between which the cylinder shaft and the sleeve eccentric shaft are placed. When the key cylinder is rotated with respect to the sleeve by the proper key being inserted in the key cylinder, the spring imparts returning force to the cylinder shaft that is making an arcuate movement. When the key cylinder and the sleeve are rotated together by an improper key being inserted in the key cylinder, the cylinder shaft is rotated around the center line of the sleeve between the two legs of the spring without deforming the spring.

According to a further aspect of the invention, there are provided a sleeve shaft eccentric to the sleeve and axially projecting therefrom; a cylinder shaft deviated from a center line of the key cylinder and axially projecting from the key cylinder; first and second case shafts eccentric to the case and axially projecting from the case; an inside lever rotatably attached to the sleeve shaft, and having a cut that fits with the cylinder shaft, and a lever shaft axially projecting along the center line of the key cylinder passing through a circular-arc groove formed in the case and located between the first and second case shafts; an outside lever rotatably attached to the first case shaft, and having a receptacle hole that fits with the lever shaft; and a spring coiled on the first case shaft, and having two legs between which the lever shaft and the second case shaft are placed. When the key cylinder is rotated with respect to the sleeve by the proper key being inserted into the key cylinder, the inside lever is rotated around the sleeve shaft, so that the spring imparts returning force to the lever shaft that is making an arcuate movement in the circular-arc groove. When the key cylinder and the sleeve are rotated together by an improper key being inserted in the key cylinder, the lever shaft is rotated on the center line of the key cylinder in the circular-arc groove of the case and between the two legs of the spring without deforming the spring.

With the above constitution, when the key cylinder is rotated by the proper key being inserted in the key cylinder, the tumblers are disengaged from the engaging portion of the sleeve and the key cylinder is rotated relative to the sleeve. Therefore, the cylinder shaft is rotated around the central axis of the key cylinder, and a lock device can be locked or unlocked by the rotation of the cylinder directly or through the lever. When the rotational force is removed from the key at the locked or unlocked position, the key cylinder can be automatically returned by resilience of the spring from the rotated position to the original position.

When an improper key is inserted into the key cylinder and turned, the key cylinder and the sleeve are rotated together and the cylinder shaft does not elastically deform the spring.

DESCRIPTION OF THE PREFERRED EMBODIMENTS

Key cylinder automatic returning devices for a cylinder lock device according to embodiments of the present invention will be hereinafter described with reference to FIGS. 1–11.

Figure 1:
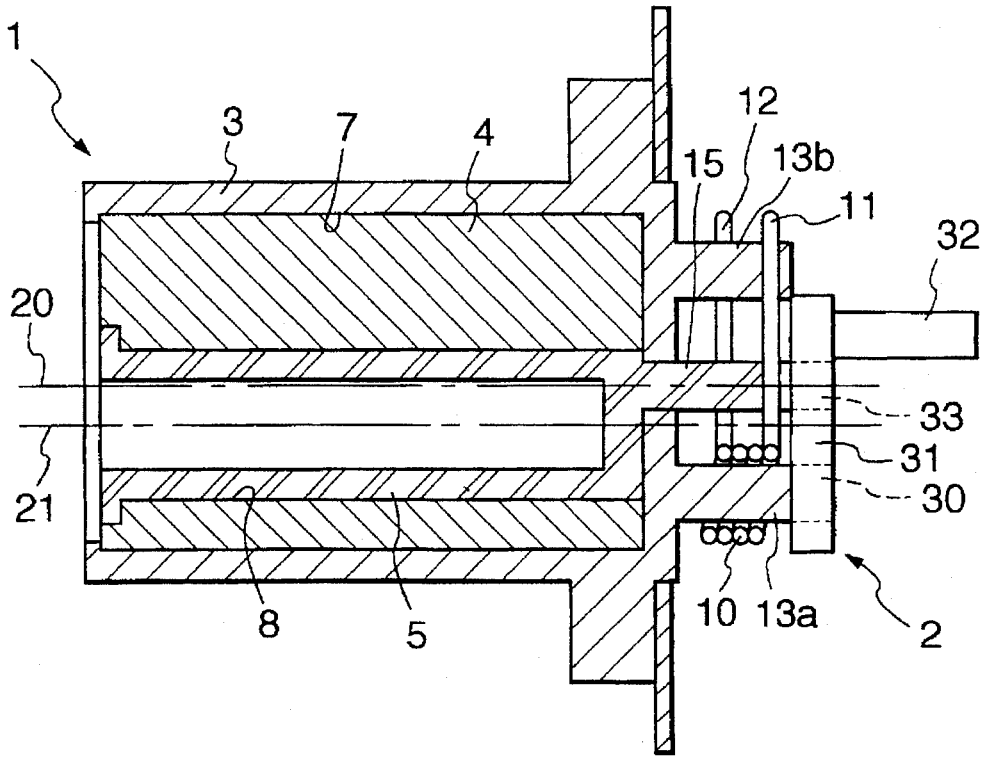
FIG. 1 is a sectional view showing a key cylinder automatic returning device for a cylinder lock device according to a first embodiment of the present invention.
Figure 2:
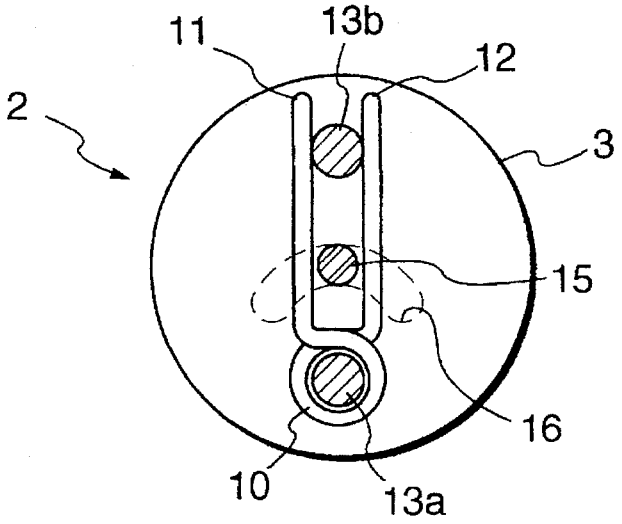
FIG. 2 is a rear view of the device of FIG. 1.

As shown in FIG. 1, a cylinder lock device 1 according to a first embodiment of the invention has a case 3 provided with a first housing 7, a sleeve 4 that is rotatably incorporated in the first housing 7 of the case 3 and provided with a second housing 8, and a key cylinder 5 rotatably installed in the second housing 8 of the sleeve 4. As illustrated in FIG. 2, a circular-arc groove 16 is formed in the case 3. Tumblers (not shown) such as disk tumblers or pin tumblers are slidably arranged in the key cylinder 5 by the known method. The tumblers are engaged with an engaging portion that is, for instance, tumbler grooves or pin holes of the sleeve 4 so as to be separable therefrom.

A key cylinder automatic returning device 2 of this cylinder lock device 1 is provided with a cylinder shaft 15 that projects from the key cylinder 5 along the central axis 20 of the sleeve 4 passing through the circular-arc groove 16 of the case 3, and a pair of case shafts **13*a* and 13*b* that project from the case 3. A spring 10 is coiled on the case shaft 13*a*. The cylinder shaft 15 is so disposed as to be closer to the case shaft 13*a* than the case shaft 13*b*. The cylinder shaft 15 and the case shaft 13*b* are placed between both legs 11 and 12 of the spring 10. A lever 31 that is rotatably supported by a through-hole 30 is fixed to the case shaft (pivot) 13*a* with a clip or the like (not shown). The lever 31 has a through-hole 33 into which the cylinder shaft 15 is inserted and an arm 32** for driving a lock device (not shown).

With the aforementioned structure, when the proper key is inserted into the key cylinder 5 and turned, the tumblers are disengaged from the engaging portion of the sleeve 4 and the key cylinder 5 is rotated relative to the sleeve 4. As a result, the cylinder shaft 15 makes an arcuate movement around the central axis 21 of the key cylinder 5 while being confined by the circular-arc groove 16 formed in the case 3. The arcuate movement of the cylinder shaft 15 causes the lever 31 to be rotated around the case shaft (pivot) **13*a*, so that the arm 32 locks or unlocks the lock device. When the cylinder shaft 15 is rotated to the locked position or the unlocked position, the spring 10 imparts returning force to the cylinder shaft 15 at a location between the fixed case shafts 13*a* and 13*b*. Therefore, when the rotational force is removed from the key in the locked or unlocked position, the key cylinder 5 can be automatically returned from the rotated position to the original position by resilient force of the spring 10**.

When an improper key is inserted into the key cylinder 5 and turned, the key cylinder 5 and the sleeve 4 are rotated together around the central axis 20 of the sleeve 4 and the cylinder shaft 15 does not elastically deform the spring 10. That is, the cylinder shaft 15 is rotated on the central axis 20 of the sleeve 4 within the circular-arc groove 16 of the case 3 and between both legs 11 and 12 of the spring 10, without deforming the spring 10.

Figure 3:
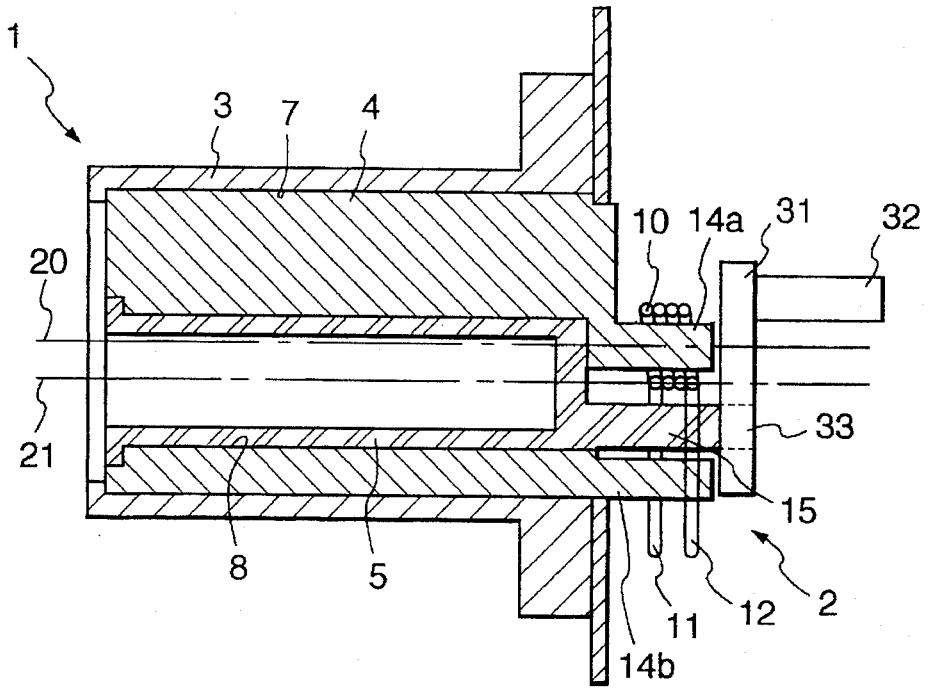
FIG. 3 is a sectional view showing a key cylinder automatic returning device for a cylinder lock device according to a second embodiment of the invention.
Figure 4:
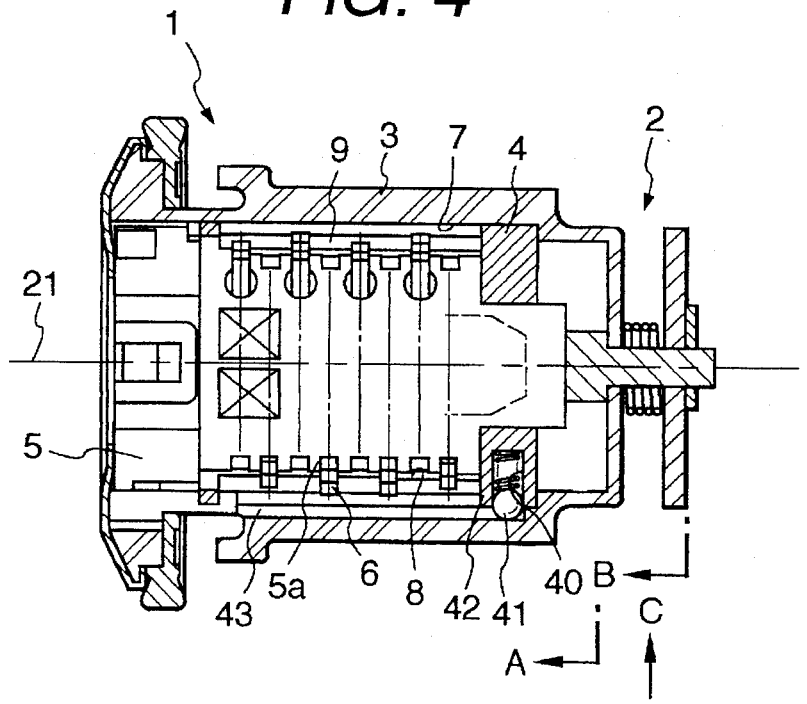
FIG. 4 is a top sectional view showing a key cylinder automatic returning device for a cylinder lock device according to a third embodiment of the invention.

FIG. 3 is a sectional view illustrating a second embodiment of the invention. In FIGS. 3–11, the parts corresponding to those in FIGS. 1 and 2 are given the same reference symbols and descriptions therefor will be omitted.

A cylinder lock device 1 shown in FIG. 3 is provided with a sleeve central shaft **14*a* that projects from the sleeve 4 and extends along the center line 20 of the sleeve 4, a sleeve eccentric shaft 14*b* that projects from the sleeve 4 at a position deviated from the center line 20 of the sleeve 4, a cylinder shaft 15 that projects from the key cylinder 5 at a position deviated from the sleeve eccentric shaft 14*b* and is closer to the sleeve central shaft 14*a* than the sleeve eccentric shaft 14*b*, and a spring 10 coiled on the sleeve central shaft 14*a*. The cylinder shaft 15 is inserted in a through-hole 33 of the lever 31. The cylinder shaft 15 and the sleeve eccentric shaft 14*b* are placed between both legs 11 and 12 of the spring 10**.

When the proper key is inserted into the key cylinder 5 and turned, the tumblers are disengaged from the engaging portion of the sleeve 4 and the key cylinder 5 can be rotated relative to the sleeve 4. When the key cylinder 5 is rotated with respect to the sleeve 4, the cylinder shaft 15 makes an arcuate movement around the central axis 21 of the key cylinder 5, and the arm 32 is rotated around the central axis 21 to lock or unlock a lock device. When making an arcuate movement, the cylinder shaft 15 receives a returning force from the spring 10. When the rotational force is removed from the key at the locked position or the unlocked position, the key cylinder 5 can be automatically returned from the rotated position to the original position by resilience of the spring 10.

When the key cylinder 5 is rotated by an improper key and the key cylinder 5, the sleeve 4 are thereby rotated together around the central axis 20 of the sleeve 4 and the cylinder shaft 15 does not elastically deform the spring 10. Thus, the cylinder shaft 15 is rotated together with the spring 10 around the central axis 20 of the sleeve 4 without deforming the spring 10. When an arm 32 is rotated around the central axis 21, it comes into contact with the lock device. However, when the arm 32 is rotated around the central axis 20, it does not contact with, and therefore, does not actuate the lock device.

FIGS. 4–11 show a third embodiment of the invention. In a cylinder lock 1, a sleeve 4 is provided with an engaging portion 9, and a tumbler 6 is slidably provided in each of a plurality of slits 5*a* of a key cylinder 5. When the tumblers 6 project from the key cylinder 5, they can contact with the engaging portion 9 of the sleeve 4. A slot 40 is formed in the sleeve 4 in the radial direction, and a spring 42 and a ball 41 are placed in the slot 40. The ball 41 is pushed outward in the radial direction by resilience of the spring 42 against a V-shaped groove 43 that is formed in a case 3. When the sleeve 4 and the key cylinder 5 are rotated together by an improper key, the sleeve 4 can be returned to the regular position by the ball 41 being in engagement with the groove 43. The groove 43 serves as a water path to remove water that has been introduced into the cylinder lock 1.

Figure 5:
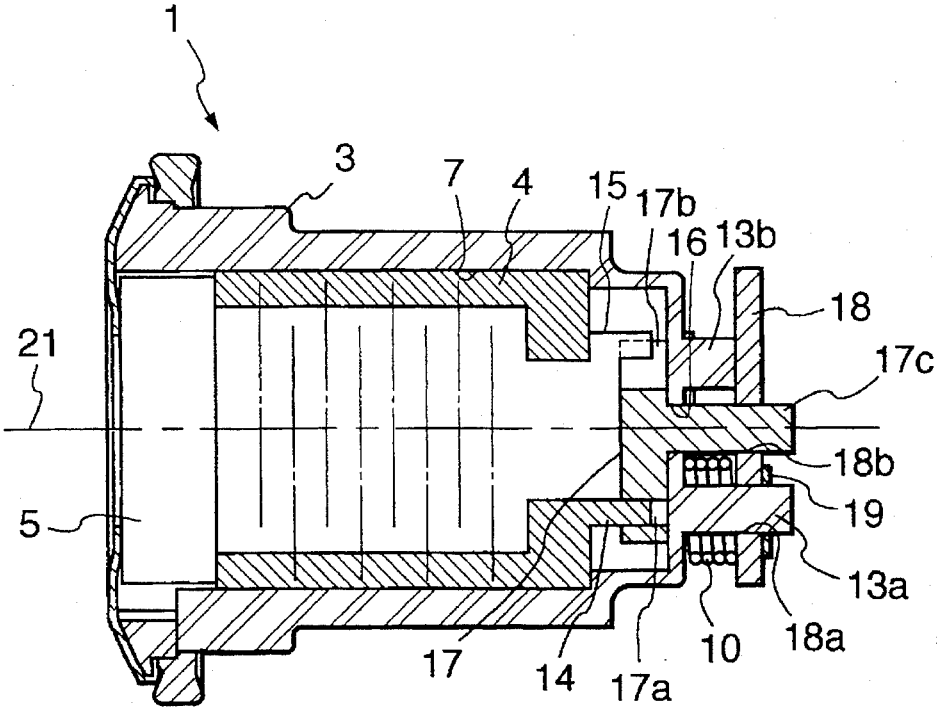
FIG. 5 is a side sectional view taken along line C of FIG. 4.
Figure 6:
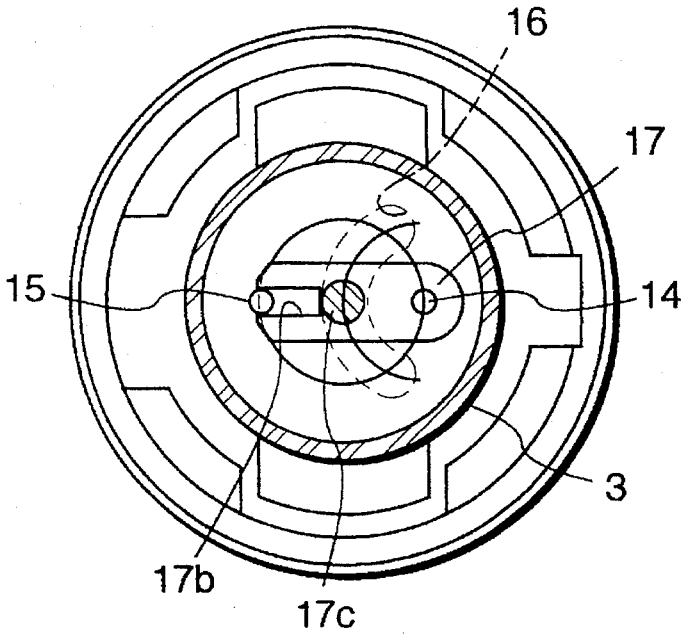
FIG. 6 is a side sectional view taken along line A in FIG. 4.
Figure 7:
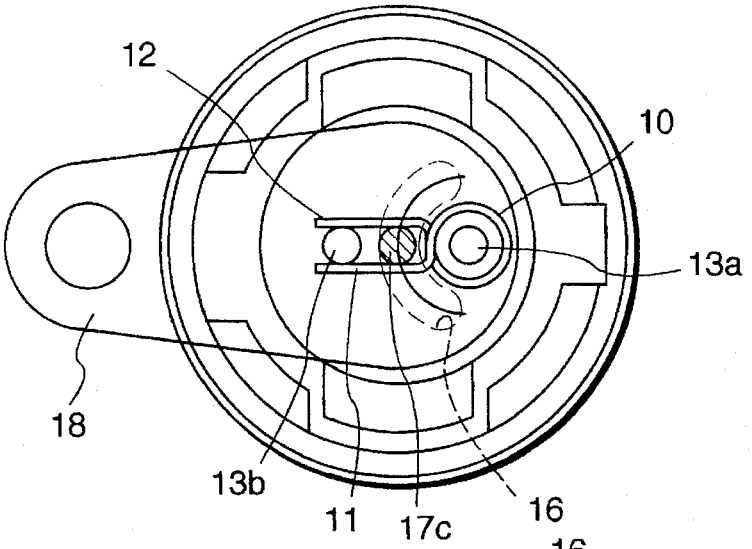
FIG. 7 is a sectional view taken along line B in FIG. 4.
Figure 8:
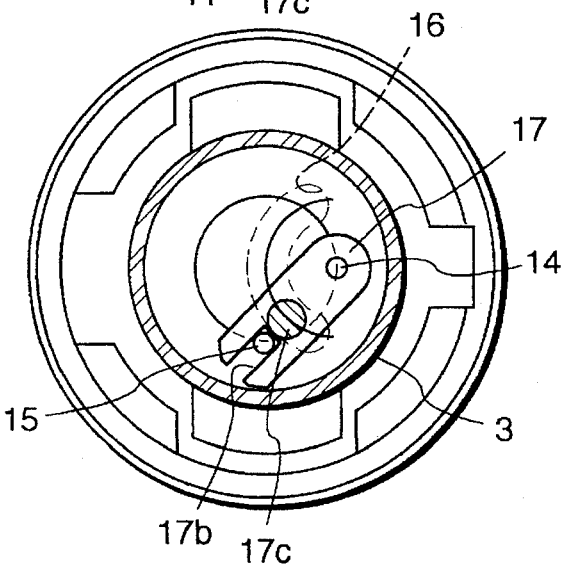
FIG. 8 is a sectional view taken along line A in FIG. 4 showing a state in which a key cylinder is rotated by the proper key.
Figure 9:
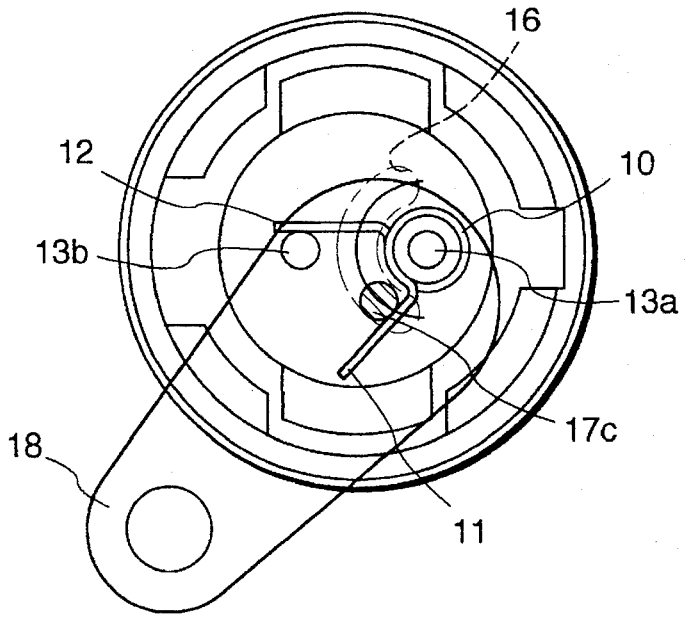
FIG. 9 is a sectional view taken along line B in FIG. 4 showing a state in which the key cylinder is rotated by the proper key.
Figure 10:
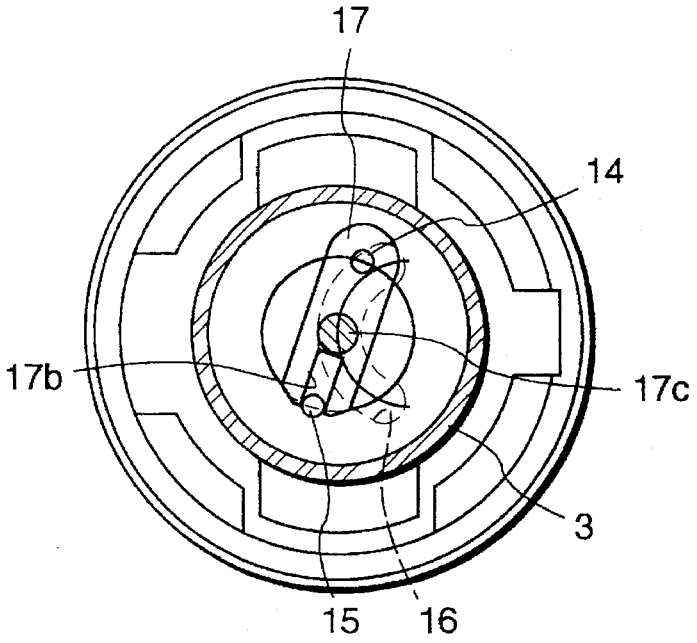
FIG. 10 is a sectional view taken along line A in FIG. 4 showing a state in which the key cylinder is rotated by an improper key.
Figure 11:
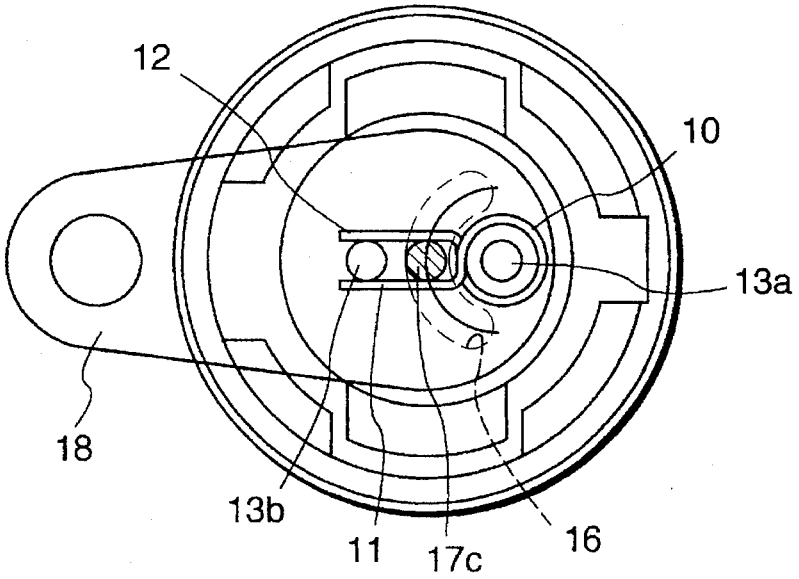
FIG. 11 is a sectional view taken along line B in FIG. 4 showing a state in which the key cylinder is rotated by an improper key.

As shown in FIG. 5, the cylinder lock 1 of this embodiment is provided with a sleeve shaft 14 eccentric to the sleeve 4 and projecting therefrom axially and a cylinder shaft 15 deviated from a central axis 21 of the key cylinder and axially projecting from the key cylinder 5. The sleeve shaft 14 is inserted into a through-hole 17*a* of an inside lever 17, and the inside lever 17 is rotatably mounted on the sleeve shaft 14. The inside lever 17 is provided with a lever shaft 17*c* and a cut 17*b* that fits with the cylinder shaft 15. The lever shaft 17*c* projects axially along the central axis 21 of the key cylinder 5 passing through a circular-arc groove 16 formed in the case 3. The case 3 is provided with a pair of case shafts 13*a* and 13*b* both of which are deviated from the central axis 21 of the key cylinder 5 and extend axially. The case shaft 13*a* fits into a through-hole 18*a* of an outside lever 18 to rotatably support the outside lever 18. The outside lever 18 is provided with a receptacle hole 18*b* that fits with the lever shaft 17*c*, and a bracket 19 attached to the case shaft 13*a* prevents the outside lever 18 from falling off. A spring 10 is coiled on the case shaft 13*a*. The lever shaft 17*c* is located closer to the case shaft 13*a* than the case shaft 13*b*. The lever shaft 17*c* and the case shaft 13*b* are placed between both legs 11 and 12 of the spring 10.

With the above structure, when no key is inserted into the key cylinder 5, the key cylinder 5, sleeve 4, inside lever 17, and outside lever 18 are in the neutral positions as shown in FIGS. 4–7. When the key cylinder 5 is rotated by the proper key being inserted in the key cylinder 5, the tumblers 6 are disengaged from the engaging portion 9 of the sleeve 4 and the key cylinder 5 can be rotated relative to the sleeve 4. As a result, the cylinder shaft 15 is rotated around the central axis 21 of the key cylinder 5, and the lever shaft 17*c* of the inside lever 17 makes an arcuate movement in the circular-arc groove 16 of the case 3 around the sleeve shaft 14. Therefore, the inside lever 17 is rotated from the neutral position (see FIG. 6) to the operating position (locked position or unlocked position; see FIG. 8) around the sleeve shaft 14, and the outside lever 18 is rotated from the neutral position (see FIG. 7) to the operating position (locked position or unlocked position; see FIG. 9) around the case shaft 13*a*. Thus, a lock device can be locked or unlocked by the rotation of the cylinder shaft 15 through the action of the inside lever 17 and the outside lever 18.

When the lever shaft 17*c* is rotated in the circular-arc groove 16, both legs 11 and 12 of the spring 19 impart returning force to the lever shaft 17*c*. When the rotational force is removed from the key located at the operating position, the key cylinder 15 can be automatically returned from the rotated position to the original position by resilience of the spring 10 through the action of the inside lever 17.

When the key cylinder 5 and the sleeve 4 are rotated together by an improper key being inserted in the key cylinder 5, the lever shaft 17*c* is rotated on the central axis 21 of the key cylinder 5 and therefore does not make an arcuate movement. As a result, the inside lever 17 rotates but does not make an arcuate movement (see FIG. 10), and the outside lever 18 is left in the neutral state (see FIG. 11). Therefore, the lever shaft 17*c* is rotated on the cylinder axis 21 in the circular-arc groove 16 of the case 3 and between both legs of the spring 10, without deforming the spring 10.

As described above, according to the invention, the key cylinder automatic returning device causes the key cylinder to automatically return to the original position when it is rotated by the proper key. Therefore, the key can be pulled out from the key cylinder in the rotated position; that is, a free-turn lock device can be operated more easily.

What is claimed is:

1. A key cylinder lock and key cylinder automatic returning device comprising:

a case having a first housing;

a sleeve rotatably incorporated in said first housing of said case and said sleeve having a second housing and an engaging portion;

a key cylinder rotatably incorporated in said second housing of said sleeve;

tumblers slidably arranged in said key cylinder and capable of engaging with said engaging portion of said sleeve, wherein said key cylinder is rotated with respect to said sleeve then a proper key is inserted into said key cylinder and turned, and said key cylinder and said sleeve are rotated together when an improper key is inserted into said key cylinder and turned;

first and second case shafts projecting from said case;

a cylinder shaft projecting from said key cylinder along a center line of said sleeve, and located between said first and second case shafts; and a spring coiled on said first case shaft, and having two legs between which said cylinder shaft and said second case shaft are placed, wherein when said key cylinder is rotated with respect to said sleeve by the proper key being inserted in said key cylinder, said spring imparts returning force to said cylinder shaft that is making an arcuate movement in a circular-arc groove formed in said case; and wherein when said key cylinder and said sleeve are rotated together by the improper key being inserted in said key cylinder, said cylinder shaft is rotated on a center line of said sleeve in the circular-arc groove of said case and between said two legs of said spring without deforming said spring.

2. A key cylinder lock and key cylinder automatic returning device comprising:

a case having a first housing;

a sleeve rotatably incorporated in said first housing of said case, and said sleeve having a second housing and an engaging portion;

a key cylinder rotatably incorporated in said second housing of said sleeve;

tumblers slidably arranged in said key cylinder and capable of engaging with said engaging portion of said sleeve, wherein said key cylinder is rotated with respect to said sleeve then a proper key is inserted into said key cylinder and turned, and said key cylinder and said sleeve are rotated together when an improper key is inserted into said key cylinder and turned;

a sleeve central shaft projecting from said sleeve along a center line of said sleeve;

a sleeve eccentric shaft deviated from said center line of said sleeve and projecting therefrom;

a cylinder shaft deviated from said sleeve central shaft, projecting from said key cylinder, and located between said sleeve central shaft and said sleeve eccentric shaft; and a spring coiled on said sleeve central shaft, and having two legs between which said cylinder shaft and said sleeve eccentric shaft are placed, wherein when said key cylinder is rotated with respect to said sleeve by the proper key being inserted in said key cylinder, said spring imparts returning force to said cylinder shaft that is making an arcuate movement; and wherein when said key cylinder and said sleeve are rotated together by the improper key being inserted in said key cylinder, said cylinder shaft is rotated around said center line of said sleeve between said two legs of said spring without deforming said spring.

3. A key cylinder lock and key cylinder automatic returning device comprising:

a case having a first housing;

a sleeve rotatably incorporated in said first housing of said case and said sleeve having a second housing and an engaging portion;

a key cylinder rotatably incorporated in said second housing of said sleeve;

tumblers slidably arranged in said key cylinder and capable of engaging with said engaging portion of said sleeve, wherein said key cylinder is rotated with respect to said sleeve then a proper key is inserted into said key cylinder and turned, and said key cylinder and said sleeve are rotated together when an improper key is inserted into said key cylinder and turned;

a sleeve shaft eccentric to said sleeve and axially projecting therefrom;

a cylinder shaft deviated from a center line of said key cylinder and axially projecting from said key cylinder;

first and second case shafts eccentric to said case and axially projecting from said case;

an inside lever rotatably attached to said sleeve shaft, and having a cut that fits with said cylinder shaft, and a lever shaft axially projecting along said center line of said key cylinder passing through a circular-arc groove formed in said case and said lever shaft located between said first and second case shafts;

an outside lever rotatably attached to said first case shaft, and having a receptacle hole that fit with said lever shaft; and a spring coiled on said first case shaft, and having two legs between which said lever shaft and said second case shaft are placed, wherein when said key cylinder is rotated with respect to said sleeve by the proper key being inserted into said key cylinder, said inside lever is rotated around said sleeve shaft, so that said spring imparts returning force to said lever shaft that is making an arcuate movement in said circular-arc groove; and wherein when said cylinder and said sleeve are rotated together by the improper key being inserted in said key cylinder, said lever shaft is rotated on said center line of said key cylinder in said circular-arc groove of said case and between said two legs of said spring without deforming said spring.

* * * * *